US008945486B2

(12) United States Patent
Warrick et al.

(10) Patent No.: US 8,945,486 B2
(45) Date of Patent: Feb. 3, 2015

(54) MICROWELL DEVICE

(71) Applicant: Wisconsin Alumni Research Foundation, Madison, WI (US)

(72) Inventors: Jay W. Warrick, Madison, WI (US); John Yin, Madison, WI (US); Stephen M. Lindsay, Appleton, WI (US)

(73) Assignee: Wisconsin Alumni Research Foundation, Madison, WI (US)

( * ) Notice: Subject to any disclaimer, the term of this patent is extended or adjusted under 35 U.S.C. 154(b) by 0 days.

(21) Appl. No.: 13/790,917

(22) Filed: Mar. 8, 2013

(65) Prior Publication Data

US 2014/0255276 A1 Sep. 11, 2014

(51) Int. Cl.
*G01N 31/16* (2006.01)
*B01L 3/00* (2006.01)

(52) U.S. Cl.
CPC ..... *B01L 3/5085* (2013.01); *Y10S 435/809* (2013.01)
USPC ..... 422/552; 422/400; 422/401; 422/407; 422/412; 422/500; 422/547; 422/551; 422/553; 422/559; 422/560; 422/561; 422/942; 422/946; 422/948; 435/3; 435/285.1; 435/286.1; 435/286.2; 435/287.2; 435/288.1; 435/288.4; 435/288.7; 435/303.1; 435/34; 435/374; 435/809; 435/6.14; 435/7.1; 435/91.2

(58) Field of Classification Search
USPC ..... 422/407, 408, 551, 552, 553, 400, 401, 422/412, 500, 547, 559, 560, 561, 942, 946, 422/948; 435/3, 285.1, 286.1, 286.2, 287.2, 435/288.1, 288.4, 288.7, 303.1, 34, 374, 6, 435/6.14, 7.1, 91.2, 809; 436/809
See application file for complete search history.

(56) References Cited

U.S. PATENT DOCUMENTS

2010/0216228 A1* 8/2010 Love et al. ..... 435/288.7

OTHER PUBLICATIONS

Ogunniyi et al., "Screening individual hybridomas by microengraving to discover monoclonal antibodies", Nature Protocols, 2009; 4(5): 767-782.
Zhu et al., "Growth of an RNA virus in single cells reveals a broad fitness distribution", Virology, Mar. 2009; 385(1):39-46.
Timm et al., "Kinetics of virus production from single cells", Virology, Mar. 2012; 424(1):11-17.
Daaboul et al., "LED-based Interferometric Reflectance Imaging Sensor for quantitative dynamic monitoring of biomolecular interactions", Biosensors & Bioelectronics, Jan. 2011; 26(5):2221-2227.
Unlu et al., "Quantitative label free high throughput protein arrays", Digest of the IEEE/LEOS Summer Topical Meetings, Jul. 2008, 61-62.

* cited by examiner

*Primary Examiner* — Dennis M White
(74) *Attorney, Agent, or Firm* — Boyle Fredrickson, S.C.

(57) ABSTRACT

A microwell device is provided. The device includes a plate having a upper surface. The upper surface has first and second recesses formed therein. Each recess has an outer periphery. First and second portions of microwells are formed in upper surface of the plate. The first portion of microwells are spaced about the outer periphery of the first recess and the second portion of microwells spaced about the outer periphery of the first recess. A first barrier is about a first portions of the microwells for fluidicly isolating the first portion of the microwells and a second barrier about a second portions of microwells for fluidicly isolating the second portion of the microwells.

14 Claims, 3 Drawing Sheets

MICROWELL DEVICE

REFERENCE TO GOVERNMENT GRANT

This invention was made with government support under RR023167 and AI091646 awarded by the National Institutes of Health. The government has certain rights in the invention.

FIELD OF THE INVENTION

This invention relates generally to microfluidic devices, and in particular, to a microwell device for isolating a fluid, such as an analyte, into very small volumes.

BACKGROUND AND SUMMARY OF THE INVENTION

Techniques for studying single cells have become indispensable in cell biology for their ability to identify characteristics and behaviors that would otherwise be hidden using population averaged measures. As single-cell techniques continue to develop, these techniques have the potential to significantly impact many different areas of study. For example, the study of virus infections and virus-host interactions are particularly well-suited for such techniques. Virus infections are generally rapid and dynamic events that exhibit high levels of heterogeneity stemming from multiple sources. Thus, at any given time during an infection, different cells can respond with phenotypically different behavior and progress at different times and rates, making it difficult to use average readouts to make inferences concerning the sequence or timing of infection events or for relating changes in one biological measure to another.

The most basic advantage of single cell data for addressing these challenges is the ability to categorize a heterogenous group of individual cells into cohorts or subpopulations with similar individual characteristics to explore the potential relationship of those characteristics to heterogenous outcomes. In other words, the heterogeneous system behavior can be leveraged to learn more about important cellular characteristics. The most prominent example of this is the use of flow cytometry, where multiple fluorescent tags or reporters can be simultaneously quantified for each cell in a population of thousands to provide exquisite, quantitative insight into the presence and nature of subpopulations. However, this powerful tool is often difficult to apply in the area of virology given the danger of contamination and production or aerosolized virus on shared flow cytometry equipment. Flow cytometry is also typically limited to endpoint analysis. Although many other single cell techniques have been developed such as droplet-based microfluidics and microfluidic flow traps, sandwiched microwells (SMAs) offer an attractive alternative with respect to flexibility, throughput, cost, and required expertise for operation. Further, SMAs offer the capability to observe single cell behavior over time.

As is known, a SMA is a sandwiched structure that is formed from a first plate with an array of microwells formed therein and a second plate that acts as a lid. When sandwiched together, the microwells and the lid create sealed chambers in which a screening reaction can be carried out. It can be appreciated that the use of microwells (wells on the order of ~1-200 μm) is prevalent in microscale device design primarily to help isolate analytes into very small volumes. By doing this, assays can be made vastly more sensitive and can be massively parallelized. Although microwells can be used to isolate small volumes of liquid for screening, they are extremely useful for isolating individual or small numbers of particles or molecules suspended in that liquid or fluid for independent analysis. These types of advantages drive much of the current research in the area of microfluidics in general. The reduced volumes of the analytes allow for more sensitive detection of proteins and other molecules given that when these molecules are produced in a microwell (100×100×100 μm=1 nano liter) during a reaction or cell culture, they are diluted into much less volume than that of a more standard reaction or culture vessel, such as a 96 well plate (200 micro liters). Consequently, a 200,000 fold reduction in volume produces a 200,000 fold increase in the concentration of the produced molecule. The increase in the concentration of the produced molecule greatly increases the ability to detect such production.

Heretofore, however, methods to interface with and leverage microwells with these types of dimensions have been limited. Current embodiments of SMAs allow only a single experimental condition to be examined per chip, thereby making it difficult to control for chip-to-chip differences. Further, current methods for loading and treating the microwells, although generally easy, are relatively difficult to control and standardize.

Therefore, it is primary object and feature of the present invention to provide a microwell device for isolating a fluid, such as an analyte, into very small volumes.

It is a further object and feature of the present invention to provide a microwell device for isolating a fluid into very small volumes which is simple to utilize and inexpensive to manufacture.

It is a still further object and feature of the present invention to provide a microwell device for isolating a fluid into very small volumes which may be used in combination with conventional micropipetting equipment.

In accordance with the present invention, a microwell device is provided. The device includes a plate having a upper surface with a plurality of microwells formed therein. The microwells are adapted for receiving a fluid therein. A barrier extends about a first portion of the microwells. The barrier prevents fluid deposited on the first portion of the microwells from flowing therepast.

A recess formed in the upper surface of the plate within the barrier. The recess has an outer periphery and the first portion of microwells are spaced about the outer periphery of the recess. The recess has a volume and each of the microwells also has a volume. The volume of the recess is greater than the volumes of the microwells.

By way of example, the barrier may be a channel formed in the upper surface of the plate. The channel has a volume which is greater than the volumes of the microwells. The barrier is generally circular. The barrier may be a first barrier and the device may also includes a second barrier extending about a second portion of the microwells. The second barrier prevents fluid deposited on the second portion of the microwells from flowing therepast.

In accordance with a further aspect of the present invention, a microwell device is provided. The device includes a plate having a upper surface with a plurality of microwells formed therein. The microwells are adapted for receiving a fluid therein. First and second recesses may also be formed in the upper surface of the plate. Each recess has an outer periphery. A first portion of microwells are spaced about the outer periphery of the first recess and a second portion of microwells are spaced about the outer periphery of the second recess.

A first barrier may be positioned between the first and second portions of microwells for fluidicly isolating the first portion of the microwells from the second portion of microwells. In addition, a second barrier may also be positioned between the first and second portions of microwells for fluidicly isolating the second portion of the microwells from the first portion of microwells. The first barrier may take the form of a first channel in upper surface of the plate that extends about the first portion of microwells. The first channel may have a generally circular configuration. It is contemplated for the first channel to have a volume and for each of the first portion of microwells has a volume. The volume of the first channel is greater than the volumes of each of the first portion of microwells. The second barrier may take the form of a second channel in upper surface of the plate that extends about the second portion of microwells.

It is intended for the first and second recesses to have volumes and for each of the first and second portions of microwells to have a volume. The volume of the first recess is greater than the volumes of each of the first portion of microwells and the volume of the second recess is greater than the volumes of each of the second portion of microwells.

In accordance with a still further aspect of the present invention, a microwell device is provided. The device includes a plate having a upper surface. The upper surface includes first and second recesses formed in the upper surface of the plate. Each recess has an outer periphery. A first portion of microwells is formed therein in the upper surface of the plate. The first portion of microwells is spaced about the outer periphery of the first recess. A second portion of microwells is also formed in the upper surface of the plate. The second portion of microwells spaced about the outer periphery of the first recess. A first barrier extends about the first portion of the microwells for fluidicly isolating the first portion of the microwells and a second barrier extends about the second portions of microwells for fluidicly isolating the second portion of the microwells.

The first barrier includes a first channel extending about the first portion of microwells. The first channel has a generally circular configuration and a volume. Each of the first portion of microwells also has a volume. The volume of the first channel is greater than the volumes of each of the first portion of microwells. The second barrier includes a second channel extending about the second portion of microwells. The first and second recesses have volumes and each of the first and second portions of microwells have a volume. The volume of the first recess is greater than the volumes of each of the first portion of microwells and the volume of the second recess is greater than the volumes of each of the second portion of microwells. A lid having a surface may also be provided. The lid is moveable between a first position wherein the surface of the lid is spaced from the upper surface of the plate and a second position wherein the surface of the lid is in engagement with the upper surface of the plate.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings.

DETAILED DESCRIPTION OF THE DRAWINGS

Figure 1:
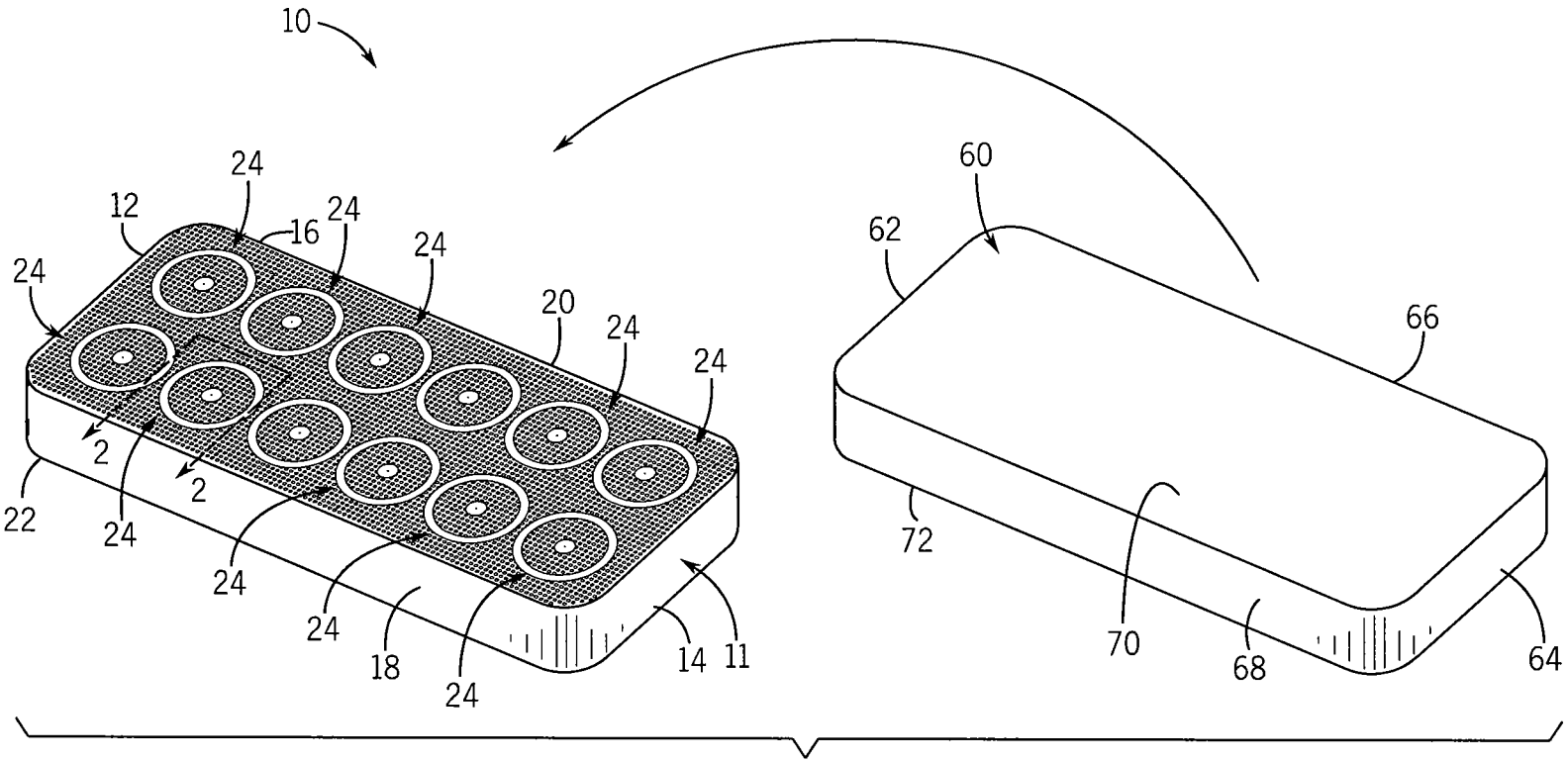
FIG. 1 is an exploded, isometric view of a microwell device in accordance with the present invention in an initial configuration.

Referring to FIG. 1, a microwell device for use in the method of the present invention is generally designated by the reference numeral 10. In the depicted embodiment, microwell device 10 includes plate 11 defined by first and second ends 12 and 14, respectively; first and second sides 16 and 18, respectively; and upper and lower surfaces 20 and 22, respectively. It can be appreciated that plate 11 of microwell device 10 may have other configurations without deviating from the scope of the present invention. Further, it is contemplated for plate 11 to be fabricated from a gas permeable material so as to facilitate cellular growth and development, as hereinafter described. However, other materials are contemplated as being with the scope of the present invention.

Figure 2:
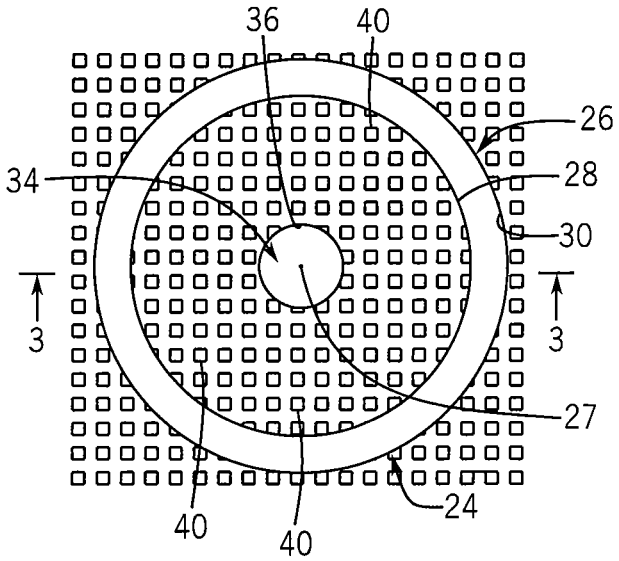
FIG. 2 is an enlarged, top plan view of the microwell device of the present invention taken along line 2-2 of FIG. 1.
Figure 3:
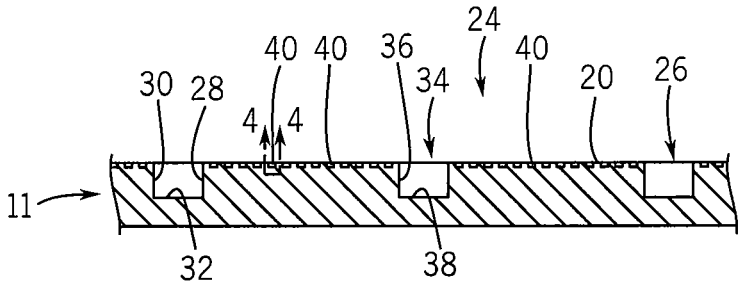
FIG. 3 is a cross-sectional view of the device of the present invention taken along line 3-3 of FIG. 2.

Upper surface 20 of plate 11 includes a plurality of microwell regions 24 formed therein. Each of the microwell regions 24 are identical in structure, and as such, the following description is understood to describe each of the microfluidic regions. Each microwell region 24 is a defined by a barrier. By way of example, the barrier may take the form of a generally circular channel, designated by the reference numeral 26, extending about center 27. FIG. 2. It can be appreciated that channel 26 can have other configurations without deviating from the scope of the present invention. As best seen in FIGS. 2-3, channel 26 is defined by generally circular, radially inner wall 28 and generally circular, outer wall 30, which are generally perpendicular to upper surface 20. Inner and outer walls 28 and 30, respectively, are interconnected by lower wall 32 extending between the lower ends thereof. It is contemplated for channel 26 to have a depth preferably in the range of 200 to 1000 micrometers and a volume in the range of 2 to 75 microliters.

Microwell region 24 further includes recess 34 centered at center 27. In the depicted embodiment, recess 34 has a generally circular cross section. However, it can be appreciated that recess 34 can have other configurations without deviating from the scope of the present invention. By way of example, recess 34 is defined by a generally circular wall 36. Wall 36 is generally perpendicular to upper surface 20 and is radially spaced from center 27. Recess 34 terminates at lower wall 38 such that recess 34 has a depth in the range of 200 to 1000 micrometers and a volume in the range of 0.025 to 3.5 microliters.

Figure 4:
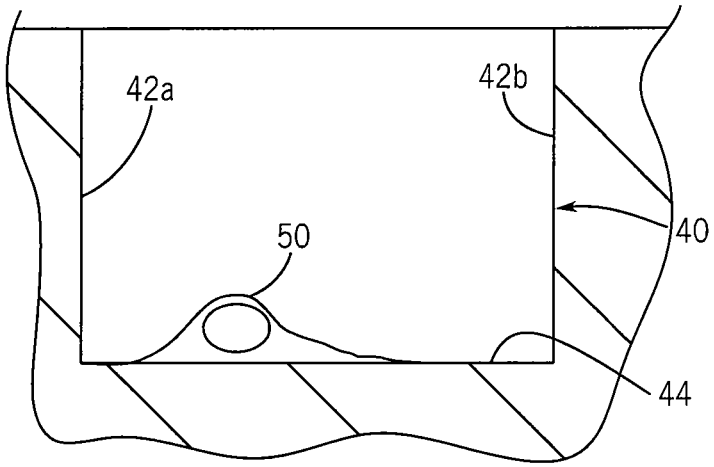
FIG. 4 is an enlarged view of the microwell device of the present invention taken along line 4-4 of FIG. 3.

Microwell region 24 further includes a plurality of rows of circumferentially spaced microwells, generally designated by the reference numeral 40. The rows of microwells 40 are radially spaced between wall 36 of recess 34 and inner wall 28 of channel 26. In the depicted embodiment, each microwall 40 has a generally cubic configuration. However, it can be appreciated that microwells 40 can have other configurations without deviating from the scope of the present invention. Referring to FIG. 4, each microwell 40 is partially defined by sidewalls **42*a*-42*b* extending generally perpendicular to upper surface 20. Sidewalls 42*a*-42*b* are interconnected by lower wall 44 extending between the lower ends thereof. It is contemplated for each microwell 40** to have a depth of approximately 50 micrometers and a volume of approximately 0.1 nanoliter.

In operation, it is contemplated to culture desired cells, generally designated by the reference numeral 50, in microwells 40 of one or more microwell regions 24 of plate 11. In order to deliver the desired cells to each microwell 40 of a selected microwell region 24, a robotic micropipetting station 52 is provided, FIG. 5. As is known, modern high-throughput systems, such as robotic micropipetting station 52, are robotic systems designed solely to position a tray (i.e. plate 11 of microwell device 10) and to dispense or withdraw microliter drops into or out of that tray at user desired locations (i.e. microwell regions 24 of plate 11) with a high degree of speed, precision, and repeatability.

Figure 5:
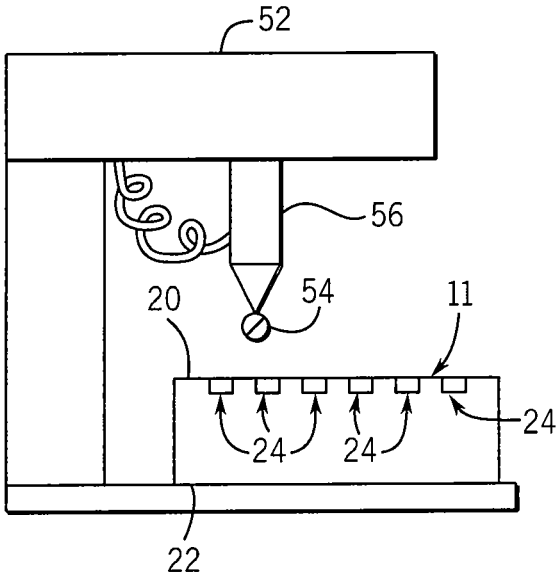
FIG. 5 is a first, side elevational view of the microwell device of the present invention positioned on a micropipetting station.
Figure 6:
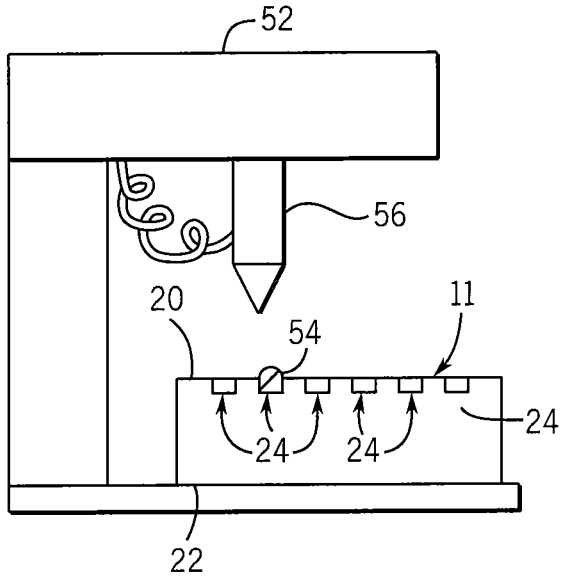
FIG. 6 is a second, side elevational view of the microwell device of the present invention positioned on a micropipetting station.
Figure 7:
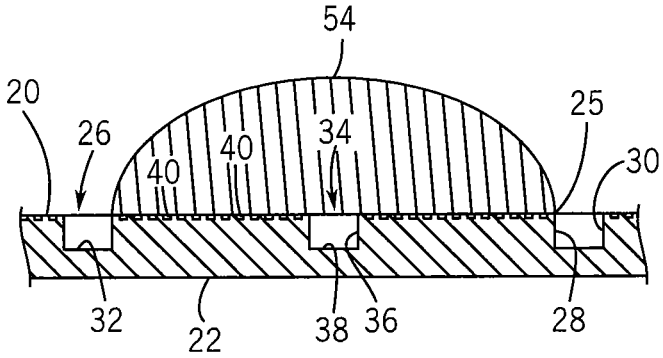
FIG. 7 is an enlarged, cross-sectional view of the microwell device of the present invention, similar to FIG. 3, with a drop of fluid deposited thereon.

As best seen in FIGS. 5-6, micropipetting station 52 includes micropipette 56 for depositing drop 54 of a fluid, e.g. a reagent or a cell suspension, on the selected microwell region 24. More specifically, micropipette 56 is axially aligned with center 27 of the selected microwell region 24, FIG. 5. Thereafter, micropipette 56 deposits drop 54 (e.g. a preselected cell suspension) on recess 34 of the selected microwell region 24. With drop 54 deposited on the selected microwell region 24, the outer periphery of drop 54 pins at radially inner edge 25 of channel 26, FIG. 7, thereby preventing the fluid of drop 54 from flowing therepast. It can be appreciated that in the event the outer periphery of drop 54 fails to pin at radially inner edge 25 of channel 26, channel 26 acts to accommodate the overflow of fluid from drop 54 and to prevent such fluid from flowing to an adjacent microwell region 24. As a result, the selected microwell region 24 is isolated from adjacent microwell regions of plate 11 of microwell device 10. As such, the cell suspension may be selectively deposited on a single microwell region 24 without contaminating adjacent regions. The cells 50 in the drop 54 are allowed to settle in microwells 40 of microwell region 24. Thereafter, any excess fluid provided on the selected microwell region 24 is aspirated.

It is understood that recess 34 allows for the complete aspiration of any excess fluid provided on the selected microwell region 24 without the excessive flows or shear normally associated therewith. More specifically, the excess portion of drop 54 deposited on the selected microwell region 24 may be aspirated at recess 34 without losing cells 50 being cultured in microwells 40 of the selected microwell region 24. Further, it is noted that after aspiration of the excess fluid of drop 54, the fluid within each microwell 40 in the selected microwell region 24 is substantially flush with upper surface 20 of plate 11, thereby allowing for the efficient washing and treatment of the cells 50 therein.

Once the excess fluid is aspirated from the selected microwell region 24, micropipette 56 of micropipetting station 52 may be used to deposit a second drop 54 (e.g. a desired analyte, a second cell suspension or the like) on recess 34 of the selected microwell region 24. Recess 34 acts to minimize the excessive flows or shear on cells 50 being cultured in microwells 40 of the selected microwell region 24. By minimizing the excessive flows or shear associated with the depositing of drop 54 on the selected microwell region 54, it is intended to prevent cells 50 being cultured in microwells 40 of the selected microwell region 24 from becoming dislodged. Thereafter, any excess fluid provided on the selected microwell region 24 may aspirated. It can be appreciated that the process heretofore described may be repeated for the treating, labeling, washing and/or conducting of experiments on cell 50, thereby allowing such steps to be conducted using a micropipette, eliminating the need to address each well individually using prohibitively expensive sub-nanoliter dispensing technologies or complicated droplet microfluidic systems.

It is further contemplated to apply lid 60 onto plate 11 of microwell device 10 to trap the cells, particles and/or fluids within microwells 40. By way of example, in the depicted embodiment, lid 60 is defined by first and second ends 62 and 64, respectively; first and second sides 66 and 68, respectively; and first and second surfaces 70 and 72, respectively. It can be appreciated that lid 60 may have other configurations without deviating from the scope of the present invention.

In operation, lid 60 is moved between a first position wherein lid 60 is spaced from plate 11 of microwell device 10 and a second position wherein first surface 70 of lid 60 is brought into contact with upper surface 20 of plate 11, thereby trapping the cells and/or fluids within microwells 40. It is noted that as lower surface 70 of lid 60 is brought into contact with upper surface 20 of plate 11, any small volumes of fluid provided on upper surface 20 of plate 11 are squished and spread along upper surface 20 within microwell regions 24. It can be appreciated that each channel 26 about a corresponding microwell region 24 is adapted to receive any excess fluid that spreads along upper surface 20 within microwell region 24, thereby preventing the fluid from flowing into adjacent microwell regions. As a result, each channel 26 about a corresponding microwell region 24 acts as a barrier during application of lid 60 to prevent fluid on upper surface 20 of one of the microwell regions 24 from flowing into and contaminating the other microwell regions 24 provided on plate 11. In view of the foregoing, it can be appreciated that channels 26 about microwell regions 24 allow a user to maintain different conditions on each microwell region 24 of plate 11.

It is further contemplated to functionalize lower surface 70 of lid 60 with antibodies to enable capture of specific analytes for surface-based detection methods, such as antibody staining, sandwich-ELISA, or label-free detection methods like the LED-based IRIS. In addition, it can be appreciated that lid 60 can be removed from plate 11 without perturbing cells 50, and thereafter, replaced to enable a variety of protocols.

Various modes of carrying out the invention are contemplated as being within the scope of the following claims particularly pointing out and distinctly claiming the subject matter, which is regarded as the invention.

We claim:

1. A microwell device, comprising:

a plate having a upper surface including a plurality of microwells formed therein, each of the microwells having a volume and being adapted for receiving a fluid therein; and a barrier extending about a first portion of the microwells, the barrier preventing fluid deposited on the first portion of the microwells from flowing therepast, wherein the barrier is a channel formed in the upper surface of the plate; and a recess formed in the upper surface of the plate within the barrier, the recess being fluidicly isolated from the barrier and having a volume greater than the volume of each of the microwells.

2. The device of claim 1 wherein the recess has an outer periphery and wherein the first portion of microwells are spaced about the outer periphery of the recess.

3. The device of claim 1 wherein the channel has a volume and wherein each of the microwells has a volume, the volume of the channel being greater than the volumes of the microwells.

4. The device of claim 1 wherein the barrier is generally circular.

5. The device of claim 1 wherein the barrier is a first barrier and wherein the device further comprises a second barrier extending about a second portion of the microwells, the second barrier preventing fluid deposited on the second portion of the microwells from flowing therepast.

6. A microwell device, comprising:

a plate having a upper surface including a plurality of microwells formed therein, each of the microwells having a volume and being adapted for receiving a fluid therein;

first and second recesses formed in the upper surface of the plate, each recess having a volume and an outer periphery;

a first barrier extending about the first recess and positioned between the first and second portions of microwells for fluidicly isolating the first portion of the microwells from the second portion of microwells, the first barrier being fluidicly isolated from the first recess, wherein the first barrier includes a first channel extending about the first portion of microwells in the upper surface of the plate;

a second barrier extending about the second recess and positioned between the first and second portions of microwells for fluidicly isolating the second portion of the microwells from the first portion of microwells, the second barrier being fluidicly isolated from the second recess; and wherein:

the volume of each of the first and second recesses is greater than the volume of each of the microwells;

a first portion of microwells is spaced about the outer periphery of the first recess; and a second portion of microwells is spaced about the outer periphery of the second recess.

7. The device of claim 6 wherein the first channel has a generally circular configuration.

8. The device of claim 6 wherein the first channel has a volume, the volume of the first channel being greater than the volumes of each of the first portion of microwells.

9. The device of claim 6 wherein the second barrier includes a second channel extending about the second portion of microwells in the upper surface of the plate.

10. A microwell device, comprising:

a plate having a upper surface, the upper surface including:

first and second recesses formed in the upper surface of the plate, each recess having an outer periphery and a volume;

a first portion of microwells formed therein, the first portion of microwells spaced about the outer periphery of the first recess and each of the first portion of microwells having a volume less than the volume of the first recess;

a second portion of microwells formed therein, the second portion of microwells spaced about the outer periphery of the second recess and each of the second portion of microwells having a volume less than the volume of the second recess;

a first barrier about the first recess and the first portion of the microwells for fluidicly isolating the first portion of the microwells, the first barrier being fluidicly isolated from the first recess, wherein the first barrier includes a first channel extending about the first portion of microwells; and a second barrier about the second recess and the second portion of microwells for fluidicly isolating the second portion of the microwells, the second barrier being fluidicly isolated from the second recess.

11. The device of claim 10 wherein the first channel has a generally circular configuration.

12. The device of claim 10 wherein the first channel has a volume, the volume of the first channel being greater than the volumes of each of the first portion of microwells.

13. The device of claim 10 wherein the second barrier includes a second channel extending about the second portion of microwells.

14. The device of claim 10 further comprising a lid having a surface, the lid moveable between a first position wherein the surface of the lid is spaced from the upper surface of the plate and a second position wherein the surface of the lid is in engagement with the upper surface of the plate.

* * * * *